US005915792A

United States Patent [19]

Sakurai

[11] Patent Number: 5,915,792

[45] Date of Patent: Jun. 29, 1999

[54] FOLDABLE KNIFE

[75] Inventor: Shigeki Sakurai, Seki, Japan

[73] Assignee: Moki Knife Company Ltd., Seki, Japan

[21] Appl. No.: 08/668,280

[22] Filed: Jun. 20, 1996

[51] Int. Cl.[6] ..... B26B 1/04

[52] U.S. Cl. ..... 30/161; 30/155

[58] Field of Search ..... 30/155, 158, 159, 30/160, 161

[56] References Cited

U.S. PATENT DOCUMENTS

| | | | |
|---|---|---|---|
| 4,604,803 | 8/1986 | Sawby | 30/161 |
| 4,606,123 | 8/1986 | Wrench | 30/161 |
| 5,095,624 | 3/1992 | Ennis | 30/161 |
| 5,325,588 | 7/1994 | Rogers | 30/161 |
| 5,495,674 | 3/1996 | Taylor, Jr. | 30/161 |
| 5,546,662 | 8/1996 | Seber et al. | 30/161 |

*Primary Examiner*—Hwei-Siu Payer
*Attorney, Agent, or Firm*—Martin E. Hsia

[57] ABSTRACT

A foldable knife includes a handle and a folding blade. The blade is pivotable about an axis between a folded position and an extended position such that a sharp edge enters the handle when it is folded. The knife also includes a mechanism for releasably locking the blade in its extended position and for applying resistance to the blade in its folded position. The mechanism includes a ratchet member having at least two notches formed therein. The ratchet member is connected to the blade. The mechanism also includes a pivotable locking lever for engaging the ratchet member for locking the blade in its extended position and for applying resistance to the blade when the blade is in its folded position. The locking lever has a extending portion that extends from the front edge of the handle so that it may be manually manipulated to disengage the locking lever from the ratchet member to release the blade from its extended position.

13 Claims, 4 Drawing Sheets

FOLDABLE KNIFE

BACKGROUND OF THE INVENTION

1. Field of the Invention

This invention generally relates to a foldable knife, and more particularly to a structure of a foldable knife in which a handle locks and pivotally supports a blade.

2. Description of the Related Art

A conventional foldable knife includes a blade 51 and a pair of halt handles 52. As shown in FIG. 5, the half handles 52 pivotally hold a blade 51. A spring 53 biases one end of a back metal 54 outward, thereby causing the opposite end 55 of the back metal 54 to engage a tang 56 of the blade 51. The blade 51 is locked either in the unfolded state as shown in FIG. 5 or in a folded state, accordingly.

A relatively burdensome procedure is required to unlock and pivot the blade 51. First, the biased end of the back metal 54 is pressed against the force of the spring 53 by using a hand of the user so that the back metal pivots around the pin 57. The other end of the back metal 54 thus disengages from the tang 56 of the blade 51. Then the blade may be extended by using the other hand of the user.

SUMMARY OF THE INVENTION

It is a major object of the present invention to provide a foldable knife with high operability having a blade which is securely locked when extended and held in place when folded in the handle.

To achieve the foregoing and other objects in accordance with the purpose of the present invention, an improved foldable knife is provided.

A foldable knife according to the present invention includes a handle having a pair of sides, a front edge and a back edge. The knife also has a folding blade having a sharp edge and a back edge opposite to the sharp edge. The blade is pivotable about an axis between a folded position and an extended position such that the back edge of the blade is aligned with the back edge of the handle when the blade is in its extended position and such that the sharp edge enters the handle through the front edge of the handle when it is folded. The knife also includes a mechanism for releasably locking the blade in its extended position and for applying resistance to the blade in its folded position. The mechanism includes a ratchet member having at least a first notch and a second notch formed therein. The ratchet member is connected to the blade. The mechanism also includes a pivotable locking lever for engaging the ratchet member or locking the blade in its extended position and for applying resistance to the blade when the blade is in its folded position. The locking lever has a portion that extends from the front edge of the handle so that it may be manually manipulated to disengage the locking lever from the ratchet member to release the blade from its extended position.

BRIEF DESCRIPTION OF THE DRAWINGS

The invention together objects and advantages thereof, may best be understood by reference to the following description of the presently preferred embodiments together with the accompanying drawings in which.

DETAILED DESCRIPTION OF THE PREFERRED EMBODIMENTS

Figure 1:
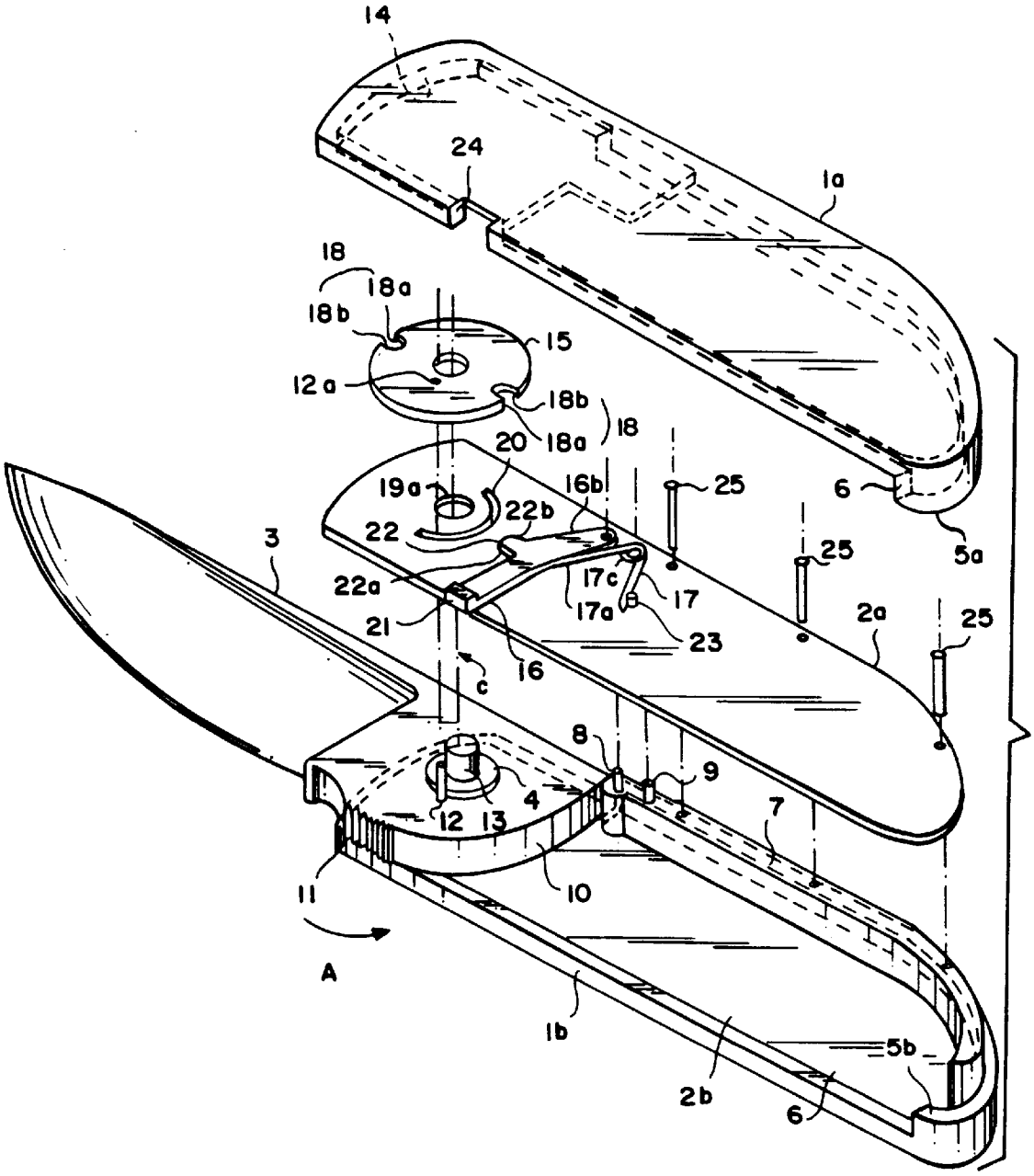
FIG. 1 is an exploded perspective view of a foldable knife according to the present invention.

An embodiment which embodies the present invention will be described below in detail referring to FIGS. 1 to 3.

A handle includes a right outer plate 1*a* and a left outer plate 1*b*. A right inner plate 2*a* and a left inner plate 2*b* are fitted in the right outer plate 1*a* and the left outer plate 1*b*, respectively. Flanges 5*a* and 5*b* are formed on the peripheral portion of the outer plates 1*a* and 1*b*, respectively, The outer plates 1*a* and 1*b* are joined together to form the handle by cementing the flanges 5*a* and 5*b* together. The space between the inner plates 2*a* and 2*b* serves as a space 6 for accommodating the blade 3 when the knife is folded. A back metal 7 is placed between the inner plates 2*a* and 2*b*. The back metal 7 is sandwiched by the inner plates 2*a* and 2*b* and fixed there with rivets 25, The outer surface of the back metal 7 fully contacts the inner wall formed by the cemented flanges 5*a* and 5*b*.

The blade 3 has a tang 10 at its proximal end. The tang 10 has a hole 26 formed therethrough. A shaft 13 is inserted in the through hole 26. The ends of the shaft 13 are screwed in the outer plates 1*a* and 1*b*, respectively. A washer 4 is placed around the shaft 13 between the tang 10 and the inner plate 2*a* and between the tang 10 and the inner plate 2*b*. The blade 3 is pivotally supported between the inner plates 2*a* and 2*b*, accordingly. A cavity 14 is formed inside a portion of the right outer plate 1*a* for accommodating a ratchet mechanism that restricts the pivotal movement of the blade 3.

Figure 2A:
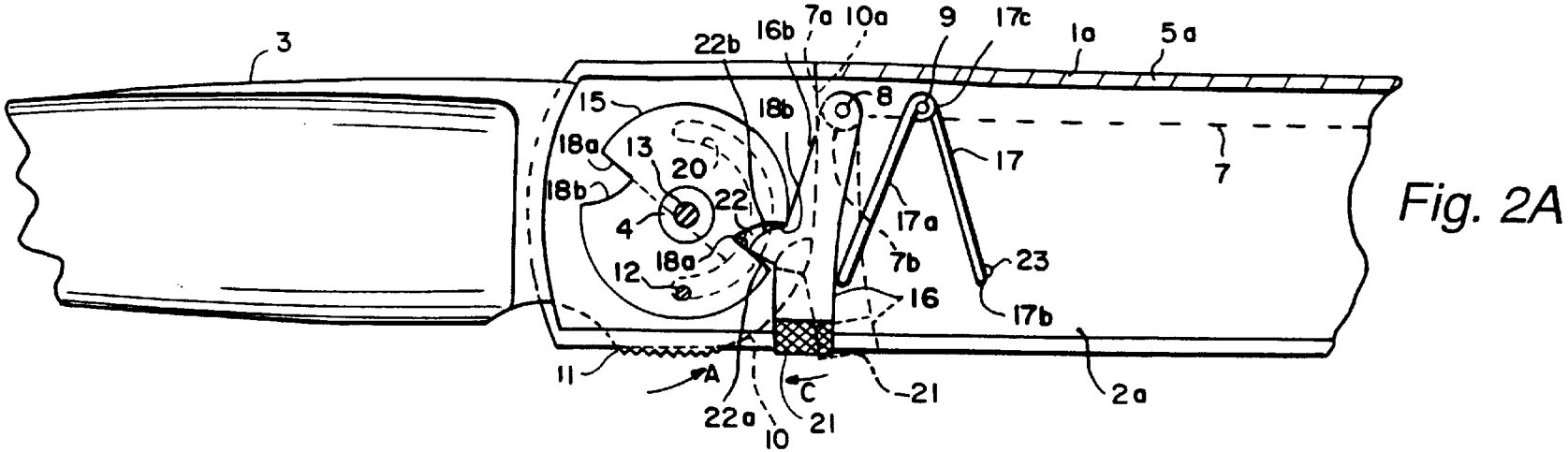
FIG. 2A is a partial sectional view of the foldable knife with its blade fully extended and FIG. 2B is a partial sectional view of the foldable knife with its blade folded.

The back metal 7 serves as a stop wall 7*a*. A part next to the stop wall 7*a* protrudes inward to form a projection 7*b*. The projection 7*b* has a half circular cross section. The stop wall 7*a* contacts the tang 10 of the blade 3 when the blade 3 is fully extended as shown in FIG. 2A. The projection 7*b* contacts the heel of the blade 3 when the blade 3 is folded as shown in FIG. 21. Shafts 8 and 9 penetrate the back metal 7. One end of each shaft 8 and 9 also penetrates the right inner plate 2*a* and contacts the right outer plate 1*a*. The other end of each shaft penetrates the left inner plate 2*b* and is screwed in the left outer plate 1*b*.

Figure 3:
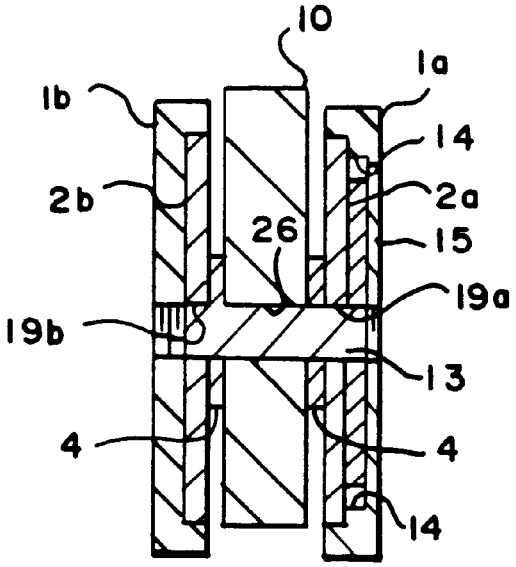
FIG. 3 is a sectional view taken along line L—L of FIG. 2B.
Figure 5:
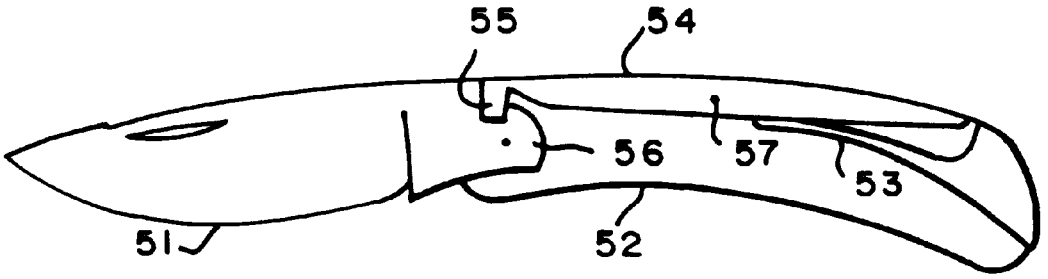
Fig. 5(Prior Art)
FIG. 5 is a sectional view illustrating a conventional knife.

As shown in FIG. 3, one end of the shaft 13 penetrates a through hole 19*b* formed on the left inner plate 2*b* and is screwed in the left outer plate 1*b*. The other end of the shaft 13 penetrates a through hole 19*a* formed on the right inner plate 2*a* and is screwed in the right outer plate 1*a*.

Figure 2B:
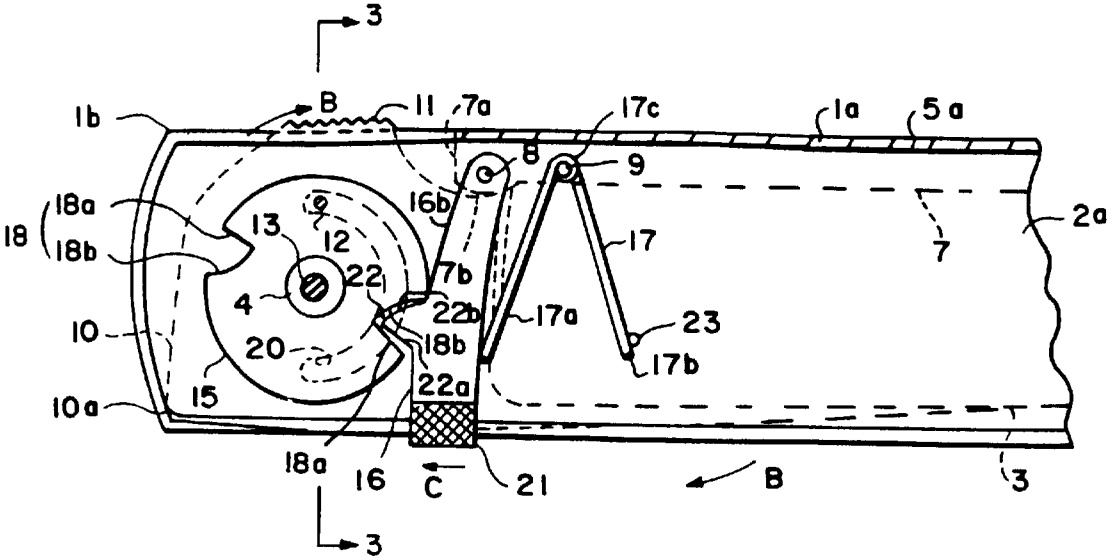

As shown in FIG. 2A, a finger lever having a serrated surface 11 is formed on the edge of the tang 10. This surface may alternatively be roughened by knurling or other similar procedure. As soon in FIG. 2A, the serrated surface 11 protrudes from the front side of the outer plates 1*a* and 1*b* when the blade 3 is extended. Moving the serrated surface 11 in the direction of arrow A rotates the blade 3 accordingly. As shown in FIG. 2B, the serrated surface 11 protrudes from the back of the outer plates 1*a* and 1*b* when the blade 3 is folded. Moving the serrated surface 11 in the direction of arrow B rotates the blade 3 in the same direction.

A part of the tang 10 adjacent to its back serves as a contact wall 10*a*. The contact wall 10*a* contacts the stop wall 7*a* of the back metal 7 when the blade 3 is fully extended. This restricts further rotation of the blade 3 in the opposite direction of arrow A.

A half ring shaped slit 20 is formed on the right inner plate 2*a*. The slit 20 is concentric with the through hole 19*a* and has a larger radius of curvature than the diameter of the plate 4. A pin 12 is provided on the surface of the tang 10 facing the right inner plate 2*a*. The distal end of the pin 12 is inserted in the slit 20. The pin 12 slides in the slit 20 as the tang 10 of the blade rotates The ratchet mechanism includes a ratchet wheel 15 provided between the right inner plate 2*a* and the right outer plate 1*a*, a locking lever 16 provided between the ratchet wheel 15 and a coil spring 17. The ratchet wheel 15 is rotatably supported by the shaft 13. The distal end of the pin 12, which protrudes from the slit 20 of the inner plate 2*a*, is inserted in a hole 12*a* formed on the ratchet wheel 15. The pin 12 moves within the slit 20, thereby restricting the rotational movement of the ratchet wheel 15, accordingly.

A pair of notches 18 are formed in the periphery of the wheel 15 opposite to each other. Each notch 18 includes a straight part 18*a* and a curled part 18*b*. As shown in FIG. 2A, imaginary lines extended from the straight part 18*a* of each notch are practically parallel and the distance from the center of the wheel 15 to the imaginary lines are equal, One end of the locking lever 16 is pivotally supported by the shaft 8, and the other end has a projection 21. The projection 21 protrudes from a notch 24 formed on the front side of the right outer plate 1*a*. The notch 24 is large enough to allow the projection 21 to be moved for controlling the blade 3. Moving the projection 21 in the direction of arrow C and in the opposite direction causes the locking lever 16 to pivot around the shaft 8. The locking lever 16 has a pawl 22 in the approximate center of a side 16*b* facing the ratchet wheel 15. The pawl 22 engages and disengages with the notches 18. The pawl 22 has a straight part 22*a* and a curved part 22*b* that correspond to the notches 18.

The coil spring 17 has a ring portion 17*c*. The coil spring 17 is attached to the inner plate 2*a* at a ring portion 17*c* by the shaft 9. One end 17*b* of the coil spring 17 contacts a pin 23 provided on the right inner plate 2*a*. The other end 17*a* of the coil spring 17 contacts the locking lever 16. The coil spring 17 therefore biases the locking lever 16 in the direction of arrow C. As shown in FIG. 2A, when the blade 3 is fully extended, the coil spring 17 urges the locking lever 16 in the direction of arrow C so that the pawl 22 engages one of the notches 18. The tip of the pawl 22 contacts the straight part 18*a* of the engaged notch 18. This causes the blade 3 to be locked in position. Even partial contact of the straight part 22*a* of the pawl 22 with the straight part 18*a* of the engaged notch 18 ensures the locking of the blade 3.

As shown in FIG. 2B, when the blade 3 is folded, the coil spring 17 biases the locking lever 16 in the direction of arrow C, causing the pawl 22 to engage the other notch 18. The proximate portion of the curved part 22*b* of the pawl 22 contacts the outer portion of the curved part 18*b* of the notch 18. This applies resistance to the blade 3, but does not lock it in place. This ensures that blade 3 will be held firmly in the accommodating space 6.

The procedure for extending the blade 3 from the folded state and for locking the blade 3 at the extended state will be now described. As shown in FIG. 2B, the serrated surface 11 of the tang 10 is moved in the direction of arrow B. This rotates the ratchet wheel 15, which is interlocked to the tang 10 with the pin 12, in the direction of arrow B. The rotation of the wheel 15 presses the curved part 18*b* of the engaged notch 18 against the curved part 22*b* of the pawl 22. This causes the pawl 22 to move against the force of the coil spring 17. The pawl 22 disengages from the notch 18 and the blade 3 slightly protrudes from the handle, accordingly. Shaking the knife applies centrifugal force to the blade 3, thereby causing the blade 3 to rotate approximately 180 degrees, The rotation of the blade 3 is stopped when the contact surface 10*a* and the stop wall 7*a* contact. At this time, the ratchet wheel 15, which is interlocked with the tang 10 of the blade 3 with the pin 12, is also rotated. When one of the notches 18 of the wheel 15 reaches the pawl 22 of tho locking lover 16, the force of the coil spring 17 pushes the locking lever 16 so that the pawl 22 engages the nearest notch 18. The ratchet wheel 15 thus becomes locked. This locks the blade 3, which is interlocked to the ratchet wheel 15 at its extended position.

The following procedure is taken to fold the fully extended blade 3. As shown in FIG. 2A, the locking lever 16 is moved against the force of the coil spring 17 by moving the projection 21 in the direction opposite to arrow C. This disengages the pawl 22 from the notch 18. Next, the blade 3 is slightly rotated by pushing the serrated surface 11 in the direction of arrow A. The back of the blade 3 is pressed so that the blade 3 is folded and accommodated in the space 6. At this time, the ratchet wheel 15, which is interlocked to the tang 10 of the blade 3, is also rotated. The force of the coil spring 17 pushes the locking lever 16 in the direction of arrow C. Therefore, when the nearest notch 18 reaches the pawl 22, the pawl 22 engages with it. This causes the ratchet wheel 15 and the blade 3, which is interlocked to the wheel 15, to be locked.

In the knife according to the present invention, the blade 3 is locked when the straight part 22*a* of the pawl 22 only partly contacts the straight part 18*a* of the engaged notch 18. Therefore, high accuracy is not necessarily required for forming the notches 18 and the pawl 22. Accordingly, assembling the knife does not requires precision and therefore is easy.

Although only one embodiment of the present invention has been described so far, it should be apparent to those skilled in the art that the present invention may be embodied in many other specific forms without departing from the spirit or scope of the invention. Particularly, the invention may be embodied in the following forms.

In the above described embodiment, only two notches 18 are formed. However, three or more notches may be formed on the ratchet wheel so that the blade 3 may be locked at a desired degree between 0 to 180 degrees with respect to the outer plates 1*a* and 1*b*.

Instead of the coil spring 17, other types of resilient member, such as a leaf spring or rubber, may be used.

In the above described embodiment, the tip of the back metal 7 serves as the stop wall 7*a* and part of the tang 10 serves as the contact surface 10*a* so that the stop wall 7*a* and the contact surface 1*a* contact one another to stop the rotation of the blade 3. However, as shown in FIG. 40 recesses 31 having a half circle cross section may be formed on the back of the blade 3 and on the edge side of the blade 3 next to the serrated surface 11 respectively. A projection 32 having a half circular shape in cross section may be formed at the end of the back metal 7. The rotation of the blade 3 is thus stopped by engaging the projection 32 and one of the recesses 31.

Figure 4:
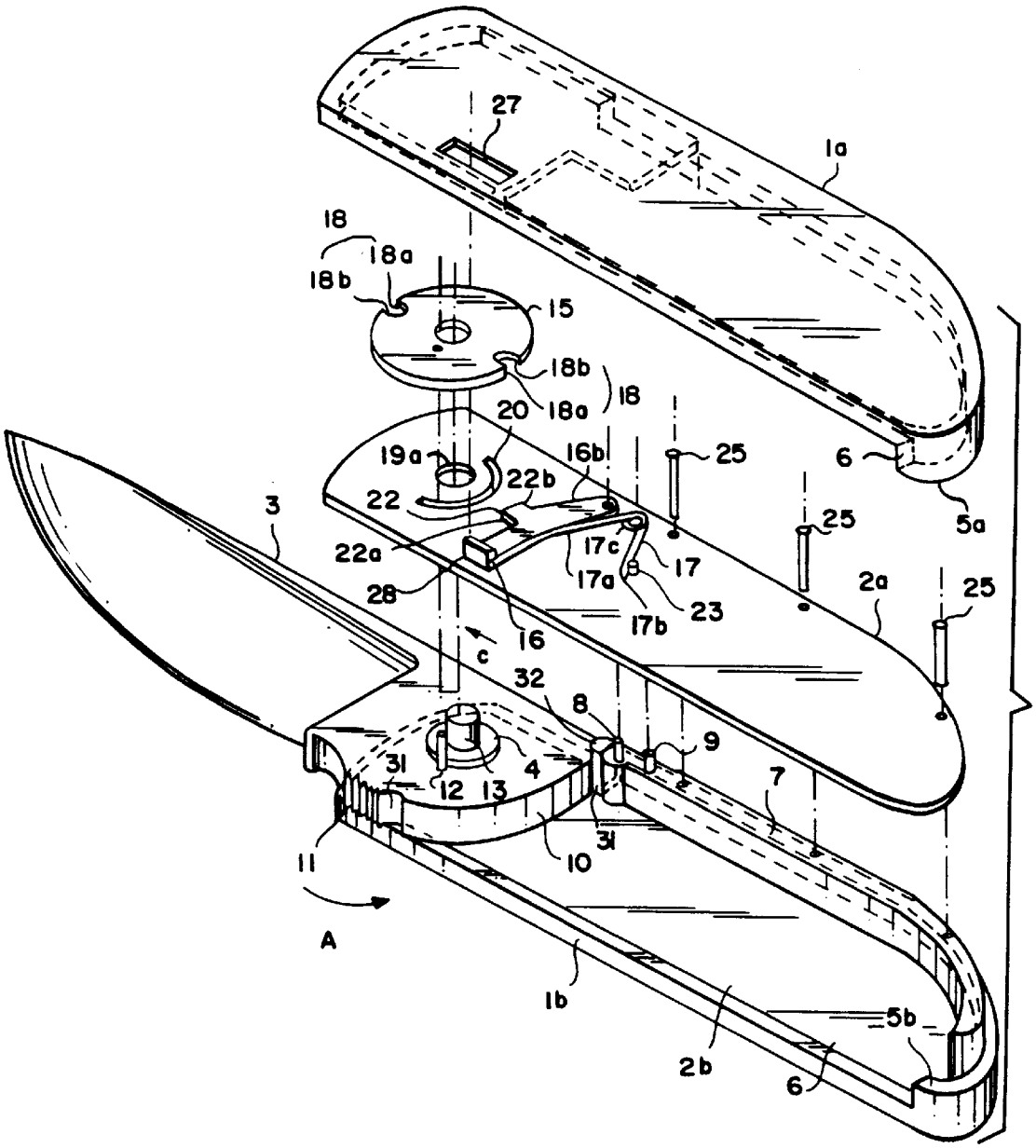
FIG. 4 is an exploded perspective view of a foldable knife according to another embodiment of the present invention.

In the first embodiment, the projection 21 of the locking lever 16 protrudes from the notch 24 formed on the edge of the right outer plate 1*a*. However, as shown in FIG. 4, a slot 27 may be formed on the right outer plate 1*a* from which the projection 28 of the locking lever 16, which is shorter than that of the first embodiment, protrudes. Moving the projection 28 in the direction of arrow C and in the opposite direction pivots the locking lever 16 around the shaft 8. The slot 27 is large enough to allow the projection 28 to be moved for controlling the blade 3. The pawl 22 may be easily disengaged from the engaged notch 18 by simply moving the projection 28 while holding the handle in one hand. Then centrifugal force is applied to the knife by shaking the hand that is holding the knife. This causes the blade 3 and the ratchet wheel 15 to rotate approximately 180 degrees so that the pawl 22 engages the other notch 18. Accordingly, the blade 3 is easily controlled to be extended from the folded state and then locked at the extended state.

Therefore, the present examples and embodiments are to be considered as illustrative and not restrictive, and the invention is not to be limited to the details given herein, but may be modified within the scope of the appended claims.

What is claimed is:

1. A foldable knife comprising:

a handle having a pair of sides, a front edge and a back edge;

a folding blade having a sharp edge and a back edge opposite to the sharp edge, wherein the blade is pivotable about an axis between a folded position and an extended position such that the back edge of the blade is aligned with the back edge of the handle when the blade is in its extended position and such that the sharp edge enters the handle through the front edge of the handle when it is folded, wherein the blade further has a finger lever, a portion of which protrudes from one edge of the handle when the blade is in its extended position and from the other edge of the handle when the blade is in its folded position, wherein the finger lever serves to pivot the blade when manipulated; and a mechanism for releasably locking the blade in its extended position and for applying resistance to the blade when the blade is in its folded position, wherein the mechanism includes:

a ratchet member, separate from the blade, having at least a first notch and a second notch formed therein, the ratchet member being connected to the blade to pivot with the blade;

a pivotable locking lever for engaging the ratchet member for locking the blade in its extended position and for applying resistance to the blade when the blade is in its folded position, the pivotable locking lever having a portion that extends from the handle to be manually manipulated to release the blade from its extended position, wherein the locking lever has a pawl, and the pawl has a straight side and a curved side such that the shape of the pawl substantially matches that of the notches, and wherein at least a portion of the straight side of the pawl contacts the straight side of one of the notches when the blade is in its extended position and wherein at least a portion of the curved side of the pawl contacts the curved side of the other of the notches when the blade is in its folded position; and a spring for biasing the pivotable locking lever against the ratchet member.

2. A foldable knife comprising:

a handle having a pair of sides, a front edge and a back edge;

a folding blade having a sharp edge and a back edge opposite to the sharp edge, wherein the blade is pivotable about an axis between a folded position and an extended position such that the back edge of the blade is aligned with the back edge of the handle when the blade is in its extended position and such that the sharp edge enters the handle through the front edge of the handle when it is folded; and a mechanism for releasably locking the blade in its extended position and for applying resistance to the blade in its folded position, wherein the mechanism includes:

a ratchet member having at least a first notch and a second notch formed therein, the ratchet member being connected to the blade; and a pivotable locking lever for engaging the ratchet member for locking the blade in its extended position and for applying resistance to the blade when the blade is in its folded position, wherein the locking lever has a portion that extends from the front edge of the handle so that it can be manually manipulated to disengage the locking lever from the ratchet member to release the blade from its extended position.

3. The foldable knife according to claim 1, wherein the ratchet member is separate from the blade and is connected to the blade by a pin, which is offset from the pivot axis of the blade.

4. The foldable knife according to claim 1, wherein the ratchet member is a wheel having the notches formed in its periphery such that the first notch is located at a position that is diametrically opposite to the second notch.

5. The foldable knife of claim 1, wherein the notches are each defined by a straight side and a curved side.

6. The foldable knife of claim 1, wherein the locking lever is urged to pivot toward the ratchet member by a spring.

7. The foldable knife of claim 1, wherein the blade has a pivoting end that is pivotally mounted inside the handle, and the pivoting end includes a finger lever, a portion of which protrudes from the handle such that the finger lever protrudes from one edge of the handle when the blade is in its extended position and from the opposite edge of the handle when the blade is in its folded position, wherein the finger lever serves to pivot the blade when manipulated.

8. The foldable knife of claim 1, wherein the blade has a finger lever, a portion of which protrudes from the front edge of the handle when the blade is in its extended position and from the back edge of the handle when the blade is in its folded position, wherein the finger lever serves to pivot the blade when manipulated.

9. A foldable knife according to claim 1, wherein the locking lever has a pawl, and the pawl has a straight side and a curved side such that the shape of the pawl substantially matches that of the notches, wherein at least a portion of the straight side of the pawl contacts the straight side of one of the notches when the blade is in its extended position and wherein at least a portion of the curved side of the pawl contacts the curved side of the other of the notches when the blade is in its folded position.

10. A foldable knife comprising:

a handle having a pair of sides, a front edge and a back edge;

a folding blade having a sharp edge and a back edge opposite to the sharp edge, wherein the blade is pivotable about an axis between a folded position and an extended position such that the back edge of the blade is aligned with the back edge of the handle when the blade is in its extended position and such that the sharp edge enters the handle through the front edge of the handle when it is folded, wherein the blade further has a finger lever, a portion of which protrudes from one edge of the handle when the blade is in its extended position and from the other edge of the handle when the blade is in its folded position, wherein the finger lever serves to pivot the blade when manipulated; and a mechanism for releasably locking the blade in its extended position and for applying resistance to the blade when the blade is in its folded position, wherein the mechanism includes:

a ratchet member having at least a first notch and a second notch formed therein, the ratchet member being connected to the blade; and a pivotable locking lever for engaging the ratchet member for locking the blade in its extended position and for applying resistance to the blade when the blade is in its folded position, the pivotable locking lever having a portion that extends from the handle to be manually manipulated to release the blade from its extended position, wherein the portion of the locking lever extending from the handle extends from the front edge of the handle.

11. A foldable knife comprising:

a handle having a pair of sides, a front edge and a back edge;

a folding blade having a sharp edge and a back edge opposite to the sharp edge, wherein the blade is pivotable about an axis between a folded position and an extended position such that the back edge of the blade is aligned with the back edge of the handle when the blade is in its extended position and such that the sharp edge enters the handle through the front edge of the handle when it is folded, wherein the blade further has a finger lever, a portion of which protrudes from one edge of the handle when the blade is in its extended position and from the other edge of the handle when the blade is in its folded position, wherein the finger lever serves to pivot the blade when manipulated; and a mechanism for releasably locking the blade in its extended position and for applying resistance to the blade when the blade is in its folded position, wherein the mechanism includes:

a ratchet member having at least a first notch and a second notch formed therein, the ratchet member being connected to the blade; and a pivotable locking lever for engaging the ratchet member for locking the blade in its extended position and for applying resistance to the blade when the blade is in its folded position, the pivotable locking lever having a portion that extends from the handle to be manually manipulated to release the blade from its extended position, wherein the ratchet member is separate from the blade and is connected to the blade by a pin, which is offset from the pivot axis of the blade.

12. A foldable knife comprising:

a handle having a pair of sides, a front edge and a back edge;

a folding blade having a sharp edge and a back edge opposite to the sharp edge wherein the blade is pivotable about an axis between a folded position and an extended position such that the back edge of the blade is aligned with the back edge of the handle when the blade is in its extended position and such that the sharp edge enters the handle through the front edge of the handle when it is folded, wherein the blade further has a finger lever, a portion of which protrudes from one edge of the handle when the blade is in its extended position and from the other edge of the handle when the blade is in its folded position, wherein the finger lever serves to pivot the blade when manipulated; and a mechanism for releasably locking the blade in its extended position and for applying resistance to the blade when the blade is in its folded position, wherein the mechanism includes:

a ratchet member having at least a first notch and a second notch formed therein, the ratchet member being connected to the blade; and a pivotable locking lever for engaging the ratchet member for locking the blade in its extended position and for applying resistance to the blade when the blade is in its folded position, the pivotable locking lever having a portion that extends from the handle to be manually manipulated to release the blade from its extended position, wherein the notches are each defined by a straight side and a curved side.

13. A foldable knife comprising:

a handle having a pair of sides, a front edge and a back edge;

a folding blade having a sharp edge and a back edge opposite to the sharp edge, wherein the blade is pivotable about an axis between a folded position and an extended position such that the back edge of the blade is aligned with the back edge of the handle when the blade is in its extended position and such that the sharp edge enters the handle through the front edge of the handle when it is folded, wherein the blade further has a finger lever, a portion of which protrudes from one edge of the handle when the blade is in its extended position and from the other edge of the handle when the blade is in its folded position, wherein the finger lever serves to pivot the blade when manipulated; and a mechanism for releasably locking the blade in its extended position and for applying resistance to the blade when the blade is in its folded position, wherein the mechanism includes:

a ratchet member having at least a first notch and a second notch formed therein, the ratchet member being connected to the blade; and a pivotable locking lever for engaging the ratchet member for locking the blade in its extended position and for applying resistance to the blade when the blade is in its folded position, the pivotable locking lever having a portion that extends from the handle to be manually manipulated to release the blade from its extended position, wherein the locking lever has a pawl, and the pawl has a straight side and a curved side such that the shape of the pawl substantially matches that of the notches, wherein at least a portion of the straight side of the pawl contacts the straight side of one of the notches when the blade is in its extended position and wherein at least a portion of the curved side of the pawl contacts the curved side of the other of the notches when the blade is in its folded position.

* * * * *